US005427618A

United States Patent [19]

Haddix et al.

[11] Patent Number: 5,427,618

[45] Date of Patent: Jun. 27, 1995

[54] FASCIA BUCK SPINDLE

[76] Inventors: Dennis W. Haddix, P.O. Box 477, Wayne, Mich. 48185; Woodrow Haddix, Sr., 7423 Kingsley Ave., Onsted, Mich. 49265; Wilmer C. Schulz, 54360 Gratiot, Chesterfield Township, Mich. 48051

[21] Appl. No.: 105,599

[22] Filed: Aug. 12, 1993

[51] Int. Cl.[6] ..... B05C 11/00

[52] U.S. Cl. ..... 118/500; 248/127

[58] Field of Search ..... 118/500; 248/345, 345.1, 248/127; 198/803.01, 687.1; 293/120

[56] References Cited

U.S. PATENT DOCUMENTS

| | | | |
|---|---|---|---|
| 2,148,462 | 2/1939 | Harris | 432/261 |
| 2,148,463 | 2/1939 | Harris | 432/261 |
| 2,571,362 | 10/1951 | Hervey | 150/166 |
| 3,913,726 | 10/1975 | Gray | 198/803.01 |
| 4,237,992 | 12/1980 | Bristow | 248/127 |
| 4,381,055 | 4/1983 | Picaud | 198/687.1 |
| 4,427,379 | 1/1984 | Duran et al. | 432/261 |
| 5,127,359 | 7/1992 | Kannari et al. | 118/500 |
| 5,296,030 | 3/1994 | Young | 118/500 |

FOREIGN PATENT DOCUMENTS

| | | | |
|---|---|---|---|
| 2223460 | 4/1990 | United Kingdom | 118/500 |

*Primary Examiner*—Peter Chin
*Assistant Examiner*—Laura E. Edwards
*Attorney, Agent, or Firm*—Weintraub, DuRoss & Brady

[57] ABSTRACT

A buck spindle for supporting a fascia during a painting process comprises an interconnected structure of steel tubular members. Forming the structure of tubular members allows dissipation of heat, which adversely affects the paint quality of fascia and other automobile parts during the paint baking process, as well as offering a lighter weight buck. Utilizing steel prevents the deposit of a chalky residue, which occurs with aluminum cast bucks.

5 Claims, 2 Drawing Sheets

FIG 2
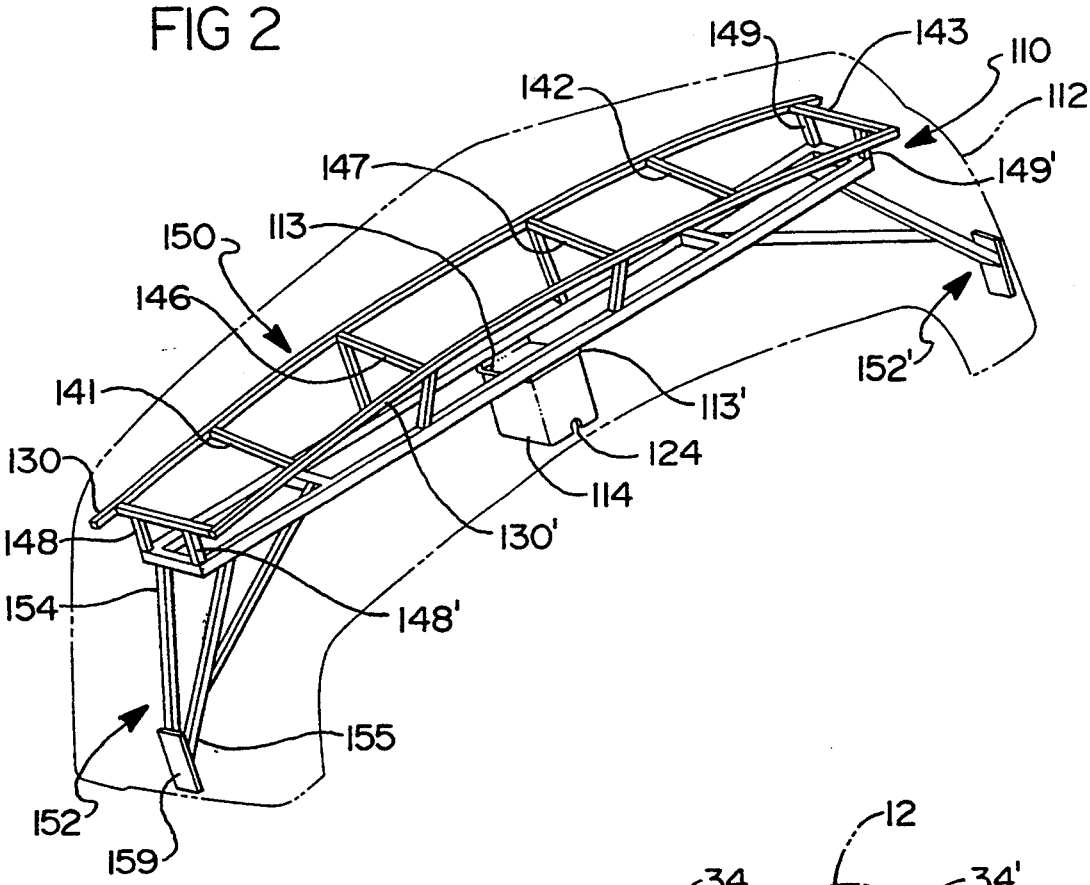
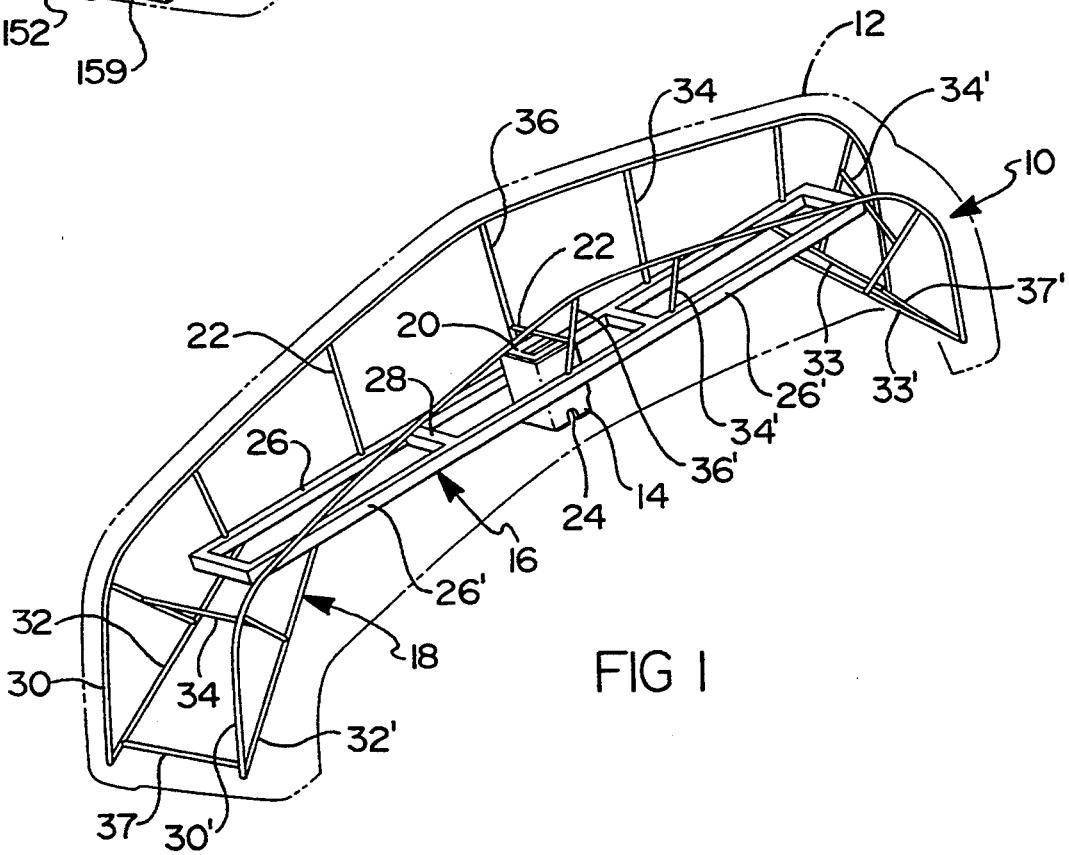
FIG 1

FIG 3
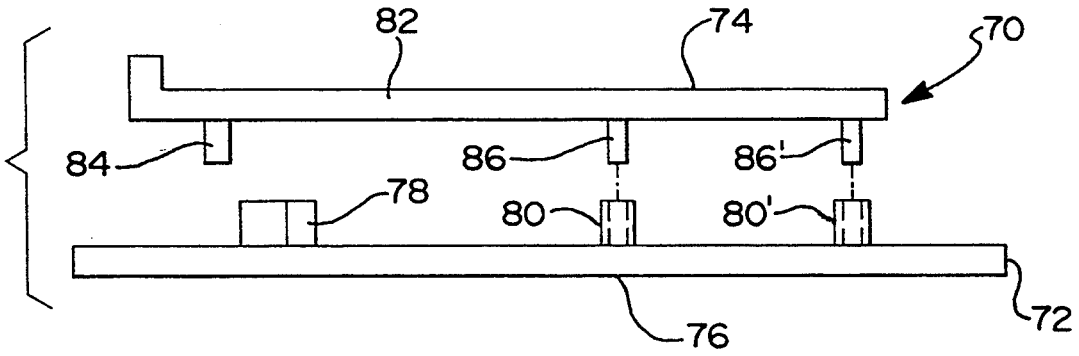
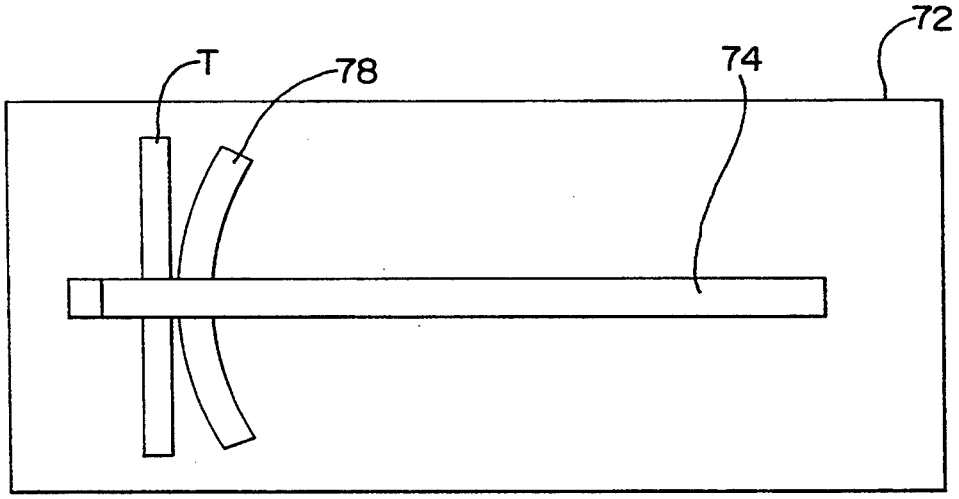
FIG 4

FASCIA BUCK SPINDLE

BACKGROUND OF THE INVENTION

I. Field of the Invention

The present invention concerns the painting of fascia for motor vehicles. More particularly, the present invention concerns an improved buck for supporting vehicular parts during the painting thereof.

II. Description of the Prior Art

The automobile manufacturers have, over time, developed a painting method for its parts which, with some variation, is standard industry practice. The process begins with the painting of the vehicle part, with primers, paints and coatings being applied. Following this,the part is subjected to a baking process, where the painted part is rapidly dried. The part is then ready for the assembly onto the vehicle.

Certain problems, however, have been encountered during the painting process. One problem is the occurrence of part deformation during the exposure to significantly elevated temperatures during the baking period. Manufacturers then developed buck spindles, generally called bucks, to address this problem. Bucks are formed to the general contours of the fascia or cladding being baked. Thus, if the oven heat would affect the integrity of the part, the buck prevents deformation.

Yet different problems are encountered by use of the buck. Bucks are currently formed of aluminum, as this lightweight metal lessens the drag upon the motors driving the assembly line. Aluminum bucks become brittle, due to the oven heat, leading to premature failure as breaks and cracks occur. Therefore, bucks can fail during baking, which invites fascia deformation. Additionally, a chalky surface forms upon the buck. This then can stain the fascia or cladding.

Another problem associated with bucks is heat transfer. Bucks are solid members, cast of aluminum. As such, bucks retain heat absorbed and poorly transfer this thermal energy. This explains, in part, the failure of the bucks. Additionally, the bucks create heat points on the fascia where the two members contact. This disrupts even baking of the fascia and, therefore, denigrates paint quality.

What is needed is a buck that can maintain fascia integrity during the drying portion of the painting process while not deteriorating due to the high heat. Further, a buck is needed that does not impart unwanted chalky residues to the fascia. It is to these needs that the present invention is directed.

SUMMARY OF THE INVENTION

The present invention concerns a buck for supporting an automobile fascia, the buck comprising:

a plurality of tubing members, the tubing members having a interior formed therein.

The fascia buck is, in the preferred embodiment, formed of steel. Additionally, the buck may further comprise a means for interconnecting the tubular members. Particularly, the means for interconnecting may comprise a plurality of joints.

The present invention will be more clearly understood with reference to the accompanying drawings and the following detailed description, in which like reference numerals will refer to like parts, and where:

BRIEF DESCRIPTION OF THE DRAWINGS

FIG. 1 is a perspective view of the first embodiment of the buck spindle of the present invention, with a fascia supported thereon shown in phantom;

FIG. 2 is a perspective view of a second embodiment of the buck spindle of the present invention, with a fascia supported thereon shown in phantom.

FIG. 3 is a side view of a pipe-bending tool of the present invention; and

FIG. 4 is a top view of the pipe-bending tool of the present invention.

Referring now to FIG. 1, there is shown the present invention, to wit, a fascia buck 10 to support a fascia 12 (shown phantom) or cladding during the painting process. The buck 10 is formed of steel, as opposed to the commonly used aluminum. Steel quickly dissipates absorbed heat. Thus, a steel buck 10 will not act as a heating source to the fascia 12. This material alteration overcomes one drawback of the common aluminum buck.

The buck 10 comprises a mount 14, a base 16 and a contact structure 18. The mount 14 and the elements forming both the base 16 and the structure 18 comprise tubular members, and particularly in the first embodiment cylindrical tubular members, for the reasons to be set forth herein below.

The mount 14 is a substantially cubic member, having an upper surface 20. The base 16 is substantially centrally mounted on the mount 14, with a cross member 22 contacting the upper surface 20. The mount 14 further has a notch 24 formed into the lower surface thereof. The notch 24 allows interaction with a conveyor belt (not shown) or other similar means to transport the buck 10 and fascia 12 through the furnace (not shown) during the drying process.

The base 16 is a substantially rectangular member, as would roughly approximate the length of a bumper or fascia. The size or configuration can be altered to accommodate a different shaped cladding or part. The base 16 has two extended tubular members 26, 26' Joined by a plurality of tubular cross members 28. The elements 26, 26' and 28 of the base 16 are tubular so that no heat is accumulated therein. The steel of the base 16 transmits the heat to the interior of its tubular elements 26, 26' and 28. This serves to dissipate the heat absorbed. Additionally, the tubular formation, although formed of a material, steel, of a higher density than aluminum, requires less material than the solid bucks currently used. Therefore, the buck 10 achieves a lower overall weight. This lessens the load upon the conveyor motor, which lessens engine wear and can quicken conveyor speed, if desired.

The base 16 may be formed as an entire unit. Alternately, the individual elements 26, 26' and 28 may be separately made and then connected together. The preferred method of connection is welding. Specific means for connecting could be elected, as will be discussed herein below.

The structure 18 comprises two extended members 30, 30' which substantially conform to the surface of fascia 12. The extended members 30, 30' bear the weight of the fascia 12. The extended members 30, 30' are Joined to the base 16 by a plurality of intermediate members 32, 32', 33, 33', 34, 34' and 36, 36' and 38, 38'. The members 32, 32' and 33, 33' serve to connect the ends of the extended members 30, 30' to the base 16. Cross members 37, 37' are Joined between the members 32, 32' and 33, 33' respectively, to give added strength to the structure 18. Cross members 35, 35' are deployed at the extreme ends of the extended members 32, 32' likewise for greater strength and stability.

The structure 18 has member 38 and 38'Joined along each extended member 30, 30' are to the base 16. The members 38, 38' support the extended members 30, 30' at a distance from the base 16 proper for the extended members 30, 30' to contact the fascia 12 correctly. Thus, the members 38, 38' serve as vertical support members.

As similarly found with the base 16, the structure 18 achieves the same heat dissipation qualities and reduced weight as found by using tubular members in the base 16. Thus, the buck 10 achieves an overall weight reduction and dissipates heat more efficiently than the commonly used aluminum buck. The advantages additionally achieved by this are a lowering in the cost of making the buck, and, additionally, the time necessary to repair this. Specifically, casting of the buck is eliminated as pre-fabricated members can be used. Additionally, since steel more efficiently transfer heat than aluminum, the cooling of the buck by water allows the steel to dissipate the heat quickly without damage to its structure. This achieves a longer lifespan for bucks 10, as opposed to the aluminum buck currently in use.

Alternately, as may be desired and is preferred in the present invention, the base 16 and structure 18 may be formed of tubular members which are individually formed to a desired shape. This shaping of the tubular members would allow for a structure 18 formed to particular specifications for a buck 10. To achieve this individual bending, a tool 70 comprising a mounting portion 72 and a lever portion 74 is used to alter the configuration of the tubular member T.

The mounting portion 72 of the tool comprises a flat member 76, preferably formed of hardened steel or similar durable material. The mounting member 72 further comprises an arcuate wedge 78 and two mounting posts 80, 80'. The mounting posts 80, 80' each have an interior cavity formed therein.

The lever portion 74 of the tool 70 comprises an arm 82 having a forward flange member 84 formed integrally thereto. The arm member 82 further has formed thereto two post members 86, 86'. The forward flange member 84 has an arcuate inner surface, the inner surface corresponding to that of the arcuate wedge 78 of the mounting member 72. The surfaces of the flange member 84 and the wedge member 78 interactively work upon the tubular member T to allow the reshaping of the tubular member T, as will be described more fully herein below. The post members 86, 86' are formed such that they may fit within the interior of the post members 80, 80' of the mounting portion 72. Ball bearings or other similar means for holding may be deployed within the interior of the mounting posts 80, 80' such that the lever portion 74 is held upon the mounting portion 72.

To effect the bending of the tubular member T, the tubular member T is placed proximate the forward edge of the arcuate wedge 78. The lever portion 74 is then brought to bear against the outer surface of the tubular member T. By nature of the ball bearings within the mounting posts 80, 80' the lever portion 74 may move laterally within the mounting posts 80, 80'. This action, combined with force applied by the operator of the tool 70, pushes the tubular member T against the arcuate member 78. This forces the tubular member T to be bent to the shape of the arcuate surface 78. The tubular member T need not be bent extensively to effect curvature of the tubular member T exactly as that of the arcuate member 78. Rather, curvatures of an angularion less than the arcuate wedge 78 can be achieved by this bending process.

Referring now to FIG. 2, there is shown a second embodiment of the buck 110 of the present invention. The buck 110 comprises a mount 114, a base 116 and a structure 118.

The mount 114 is substantially similar to the mount of the first embodiment. The mount 114 has, along its upper surface, flanged ends 113,113'. This allows the entire base to rest upon the upper surface of the mount and not be disposed along the sides thereof. The base 116 is substantially similar in all aspects to the base 116 of the first embodiment.

The structure 118 comprises an upper section 150, a first lower section 152 and a second lower section 152'. The upper section comprises two extended members 130, 130' Joined by a plurality of cross members 140, 141, 142 and 143. Additionally, the structure 118 comprises two support trusses or joist members 146, 147 disposed substantially centrally along the structure 118. These support trusses 146, 147 are attached to the base 116, and give central strength to the structure 118. Also, these members serve to transmit the weight of the fascia 112 along the base 116. Additionally, vertical members 148, 148', 149, 149' connect the structure 118 to the base 116. The first lower section 152 is substantially identical to the second lower section 152'; thus, only the first lower section 152 will be described in detail. The first lower section 152 comprises two tubular members 154, 155 disposed near the end of the base 116. A cross member 156 is Joined to the base 116 substantially equidistant between the end and the center of the base 116. These members are all connected to an support plate or end plate 159 which effect a plurality of side members. The lower section 152, 152' serve to support the extreme ends of the fascia 112. Thus, these members prevent deformation of these ends of the fascia 112, such as by sagging inwardly, when exposed to the extended heat of the baking ovens.

Another substantial difference between the second embodiment 110 is the fact that all elements of the base 116 and structure 118 are formed of tubular members having a quadrangular cross-section. Thus,these members give a larger flat surface upon which to rest a fascia 112 along the upper structure 118. These members define an interior, Just as the cylindrical tubular members of the first embodiment do. Other matters, particularly in its composition in steel, the second embodiment is similar to the first embodiment.

Thus, having described the present invention, what is claimed is:

1. A buck spindle for supporting a fascia or cladding during painting or during heat treating, the fascia having an inner surface, the buck spindle comprising:

(a) a structural base comprising a pair of extended tubular members and a plurality of tubular cross-members, the cross-members being formed to interconnect the extended members;

(b) means for mounting the structural base on a conveyor line, the means for mounting being attached to the structural base; and (c) a support structure comprising:

(1) a pair of tubular support members, the support members being substantially similar in length to the extended members:

(2) a plurality of joist members formed of tubular piping and connected to the support members, the joist members being attached to the structural base;

(d) a plurality of side members comprising a plurality of tubular members attached to and extending from the structural base.

2. The buck spindle of claim 1, wherein the means for mounting comprises a mount, the structural base being substantially normal to the mount.

3. The buck spindle of claim 1, wherein the fascia contact structure substantially conforms to the inner surface of the fascia.

4. The buck spindle of claim 1, wherein the contact structure contacts the inner surface of the fascia on a length corresponding to the inner surface of the fascia.

5. The buck spindle as set forth in claim 1, further comprising:

a plurality of side members comprising:

(1) a plurality of tubular members attached to and extending from the structural base; and (2) a support plate mounted to at least one of the plurality of tubular members.

* * * * *